US009585500B2

(12) United States Patent
Dietrich

(10) Patent No.: US 9,585,500 B2
(45) Date of Patent: Mar. 7, 2017

(54) SYSTEM AND APPARATUS FOR ASSISTING A USER IN PORTION CONTROL WHILE EATING

(71) Applicant: VisualQs, LLC, Longmont, CO (US)

(72) Inventor: Sheila Kemper Dietrich, Boulder, CO (US)

(73) Assignee: VisualQs, LLC, Boulder, CO (US)

( * ) Notice: Subject to any disclaimer, the term of this patent is extended or adjusted under 35 U.S.C. 154(b) by 0 days.

(21) Appl. No.: 14/794,077

(22) Filed: Jul. 8, 2015

(65) Prior Publication Data

US 2015/0305526 A1 Oct. 29, 2015

Related U.S. Application Data

(63) Continuation of application No. 14/320,243, filed on Jun. 30, 2014, now Pat. No. 9,351,595, and a (Continued)

(51) Int. Cl.
*A47G 19/06* (2006.01)
*A47G 19/02* (2006.01)
(Continued)

(52) U.S. Cl.
CPC ..... *A47G 19/06* (2013.01); *A47G 19/02* (2013.01); *A47G 19/025* (2013.01);
(Continued)

(58) Field of Classification Search
CPC ..... A47G 19/025; A47G 19/02; A47G 19/06; A47G 19/2227; A47G 21/145; A47G 21/14; A47G 21/04; B65D 1/36; G09B 19/0092
USPC .... 220/574.1, 575, 574, 506, 659, 657, 656, 220/23.88, 23.83; 206/563, 564, 562, 206/557, 546, 541, 223; 30/328, 327; D7/654, 653; 73/426; 434/127
See application file for complete search history.

(56) References Cited

U.S. PATENT DOCUMENTS 1,589,558 A * 6/1926 Reizenstein ..... C03C 17/02 220/574
1,848,066 A * 3/1932 Shepard ..... A47G 19/02 220/575
(Continued)

FOREIGN PATENT DOCUMENTS

JP 2001046249 A 2/2001

*Primary Examiner* — Robert J Hicks
(74) *Attorney, Agent, or Firm* — Hovey Williams LLP

(57) ABSTRACT

A system of place-setting components used to facilitate serving and eating healthy food portions. The place-setting system comprising: a plate and a nestable set of two or more serving spoons. The plate includes one or more serving areas corresponding to a portion size for one or more food components of a meal. Each of the serving spoons in the nestable set includes a bowl-shaped cup and a handle. The handle of the serving spoons comprising: a first segment, extending distally from the proximal end of the handle, with a portion of a distal-most section of the first segment extending upward; a second segment connected to the first segment, with the second segment extending downward; a third segment connected to the second segment, with the third segment extending generally upward; and a fourth segment connected to the third segment, with the fourth segment extending generally distally.

17 Claims, 8 Drawing Sheets

Related U.S. Application Data continuation of application No. 13/893,915, filed on May 14, 2013, now Pat. No. 8,763,845.

(51) Int. Cl.
*A47G 21/14* (2006.01)
*A47G 21/04* (2006.01)
*A47G 19/22* (2006.01)

(52) U.S. Cl.
CPC ..... *A47G 19/2227* (2013.01); *A47G 21/04* (2013.01); *A47G 21/145* (2013.01)

(56) References Cited

U.S. PATENT DOCUMENTS 1,943,698 A * 1/1934 Schurmann ..... A47G 19/02 220/23.8
1,958,978 A * 5/1934 Thomas ..... A47J 27/04 211/74
D122,589 S * 9/1940 Bastress ..... 220/575
RE23,918 E * 1/1955 Cowan ..... A47G 19/02 220/605
2,711,089 A * 6/1955 Dingeldein ..... A47G 33/00 206/503
D251,348 S * 3/1979 Andersen ..... D7/584
6,296,488 B1 10/2001 Brenkus et al.
D505,834 S * 6/2005 Wellner ..... D7/584
2007/0289973 A1* 12/2007 Acosta ..... A47G 19/025 220/507
2008/0206437 A1* 8/2008 Perry ..... A47J 27/10 426/614
2008/0230546 A1 9/2008 Cocchiarella
2009/0102123 A1* 4/2009 Haas ..... A63F 3/0478 273/243
2010/0304005 A1 12/2010 Beale
2012/0031805 A1 2/2012 Stolarczyk
2012/0183933 A1* 7/2012 Smiler ..... G09B 19/0092 434/127

* cited by examiner

SYSTEM AND APPARATUS FOR ASSISTING A USER IN PORTION CONTROL WHILE EATING

RELATED APPLICATIONS

This current patent application is a continuation application claiming priority benefit with regard to all common subject matter in non-provisional U.S. patent application Ser. No. 14/320,243, entitled "SYSTEM AND APPARATUS FOR ASSISTING A USER IN PORTION CONTROL WHILE EATING", filed Jun. 30, 2014. U.S. patent application Ser. No. 14/320,243 in turn is a continuation application claiming priority benefit with regard to all common subject matter in U.S. Pat. No. 8,763,845 (prosecuted as U.S. patent application Ser. No. 13/893,915), entitled "SYSTEM AND APPARATUS FOR ASSISTING A USER IN PORTION CONTROL WHILE EATING" and having a filing date of May 14, 2013. U.S. Pat. No. 8,763,845 in turn claims priority with regard to all common subject matter in U.S. Provisional Pat. App. No. 61/647,209, entitled "SYSTEM AND APPARATUS FOR ASSISTING A USER IN PORTION CONTROL WHILE EATING.", filed May 15, 2012. The above non-provisional patent application, patent and provisional patent application are hereby incorporated by reference in their entirety into the present non-provisional application.

BACKGROUND

1. Field

Embodiments of the present invention are directed to a system and an apparatus for assisting a user in portion control while eating. In particular, embodiments are directed to a system and an apparatus comprising place-setting components that are used to facilitate serving and eating healthy food portions of a meal.

2. Related Art

Recent studies indicate that a very high percentage of Americans are, or are becoming, overweight and/or obese. For example, the Center for Disease Control and Prevention has found that over 33 percent of adults in the U.S. are overweight, and more than 35 percent of adults, beyond those 33 percent of overweight adults, are obese. Thus, in total, over two-thirds of adults in the U.S. are either overweight or obese. The likelihood of serious health problems and diseases, such as heart disease, diabetes, and cancer, have been known to increase due to complications associated with being overweight and/or obese. Further, obesity is the leading cause of preventable death in the U.S. In addition to health-related issues, obesity and being overweight have significant economic issues on Americans and the U.S. population as a whole. For example, such weight-related issues are known to cause increases in medical, insurance, employment, and business costs.

A significant cause of Americans being overweight and/or obese is excessive food consumption. Such excessive food consumption is due, in part, to the size of place-setting components, such as plates, utensils, bowls, cups, or the like. For example, it has been found that plates used in the U.S. to hold food during meals have increased by at least 51 percent since the turn of the 20th century. Because of such a size increase, Americans are prone to completely fill their plates with large portions of food. As such, Americans are encouraged to consume greater amounts of food, leading them to being overweight and/or obese, which ultimately provides a negative impact on their health, finances, and overall well-being.

SUMMARY

Embodiments of the present invention include a system of place-setting components used to facilitate serving and eating healthy portions of food. The place-setting system comprises: a plate with a bottom side and a serving side and a nestable set of two or more serving spoons. The plate includes a rim section and a well section, and one or more serving areas on the serving side of the plate. The serving areas are generally positioned within the well section and each correspond to a portion size for one or more food components of a meal. Each of the serving spoons in the nestable set includes: a bowl-shaped cup, with an upper rim of the cup presenting a closed curve that lies in a reference plane, and a handle with distal and proximal ends. The handle of the serving spoons comprises: a first segment, generally arcuate in shape, extending distally from the proximal end of the handle, with a first portion of a proximal-most section of the first segment being generally parallel with the reference plane, and a second portion of a distal-most section of the first segment extending upward and presenting a longitudinal centerline forming a first angle with a portion of the reference plane that lies distally with respect to the longitudinal centerline, and the first angle being between about 30 degrees to about 150 degrees; a second segment connected to the first segment via a first arcuate connecting segment, with the second segment extending downward from the first arcuate connecting segment and presenting a longitudinal centerline forming a second angle with a portion of the reference plane that lies distally with respect to the longitudinal centerline, and the second angle being between about 15 degrees to about 165 degrees, and further with the first segment, the second segment, and the first arcuate connecting segment providing for the serving spoon to be engaged in a first position with a serving bowl, with the first position being such that the upper rim of the serving spoon faces in a generally upward direction and further such that the bowl-shaped cup is operable to maintain a food component while being engaged in the first position with the serving bowl; a third segment connected to the second segment via a second arcuate connecting segment, with the third segment extending generally upward and presenting a longitudinal centerline forming a third angle with a portion of the reference plane that lies distally with respect to the longitudinal centerline, and the third angle being between about 30 degrees to about 150 degrees, and further with the second segment, the third segment, and the second arcuate connecting segment providing for the serving spoon to be engaged in a second position with the serving bowl, with the second position being such that the upper rim of the serving spoon faces in a generally downward direction and further such that the bowl-shaped cup is operable to be emptied of any food component while being engaged in the second position with the serving bowl; and a fourth segment connected to the third segment via a third arcuate connecting segment, with the fourth segment extending generally distally and being generally parallel with the reference plane. In such an embodiment, volumes of the each of the bowl-shaped cups of each of the serving spoons in the nestable set corresponds to one of the portion sizes associated with the servings areas of the plate.

Embodiments of the present invention include an additional system of place-setting components used to facilitate serving and eating healthy food portions. The place-setting system comprises a nestable set of two or more serving spoons, with each of the serving spoons in the set including: a bowl-shaped cup, with an upper rim of the cup presenting a closed curve that lies in a reference plane and a handle with distal and proximal ends. The handle of the serving spoon comprising: a first segment, generally arcuate in shape, extending distally from the proximal end of the handle, with a first portion of a proximal-most section of the first segment being generally parallel with the reference plane, and a second portion of a distal-most section of the first segment extending upward; a second segment connected to the first segment via a first arcuate connecting segment, with the second segment extending downward from the first arcuate connecting segment, with the first segment, the second segment, and the first arcuate connecting segment providing for the serving spoon to be engaged in a first position with a serving bowl, with the first position being such that the upper rim of the serving spoon faces in a generally upward direction and further such that the bowl-shaped cup is operable to maintain a food component while being engaged in the first position with the serving bowl; a third segment connected to the second segment via a second arcuate connecting segment, with the third segment extending generally upward, with the second segment, the third segment, and the second arcuate connecting segment providing for the serving spoon to be engaged in a second position with the serving bowl, with the second position being such that the upper rim of the serving spoon faces in a generally downward direction and further such that the bowl-shaped cup is operable to be emptied of any food component while being engaged in the second position with the serving bowl; and a fourth segment connected to the third segment via a third arcuate connecting segment, with the fourth segment extending generally distally and being generally parallel with the reference plane. The bowl-shaped cup further includes a bottom-facing flat surface on its lower portion, with the bottom facing flat surface and the third segment, the third arcuate connecting segment, and the fourth segment of the handle providing for the serving spoon to be engaged in a third position with a base surface, with the third position being such that the upper rim of the serving spoon faces in a generally upward direction and further such that the bowl-shaped cup is operable to maintain a food component while being engaged in the third position with the base surface.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

Figure 1:
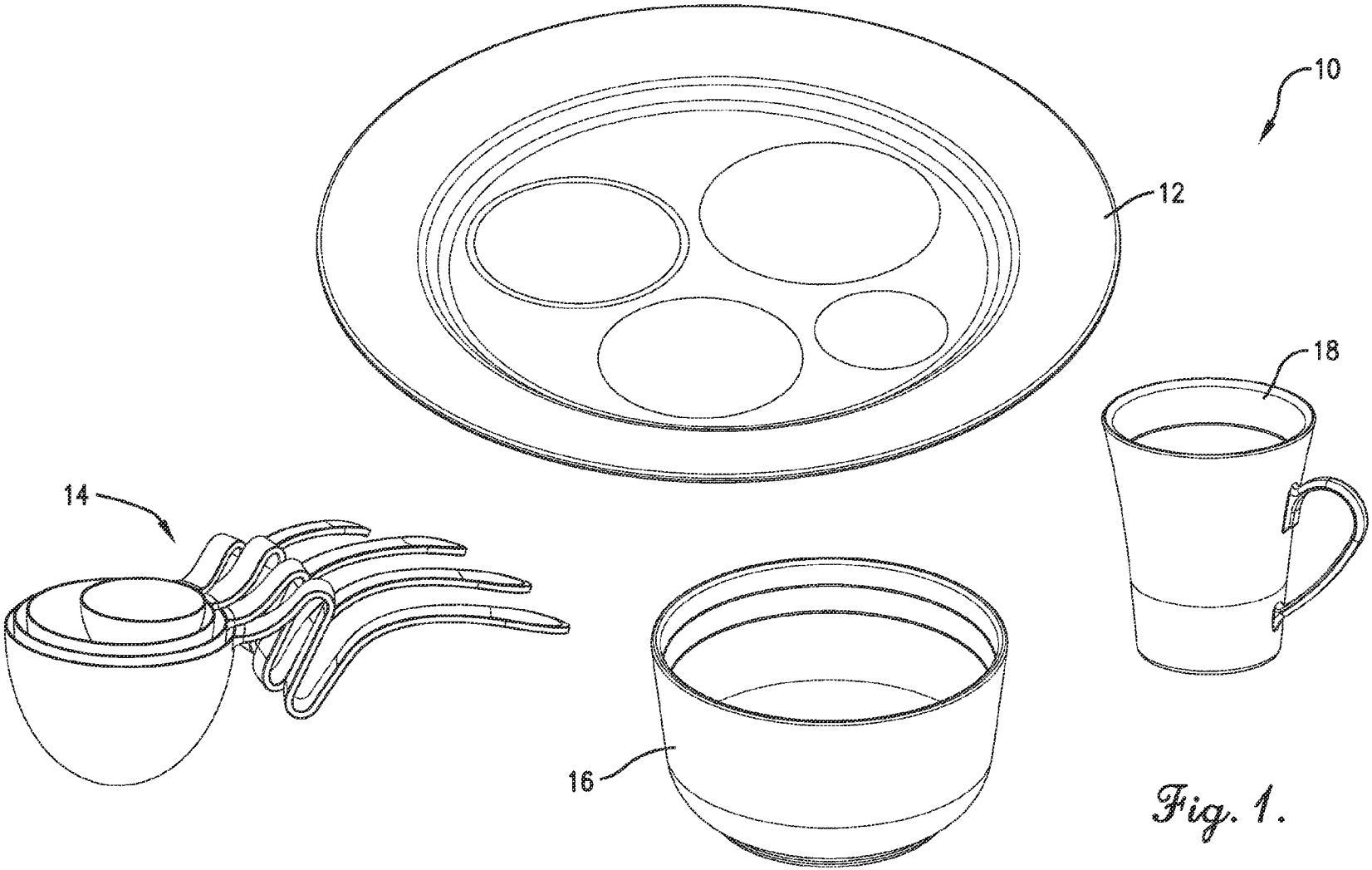
FIG. 1 is a perspective view of a plate, a nestable set of serving spoons, a bowl, and a cup of a system of place-setting components according to embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning to the drawings and as illustrated in FIG. 1, embodiments of the present invention are directed to a system 10 of place setting components comprising a plate 12 with one or more serving areas on a serving side of the plate; a nestable set of serving spoons 14, with each having a handle formed in a plurality of segments and each having a bowl-shaped cup that is associated with a serving area on the plate; a bowl 16 with one or more fill indicias for indicating one or more portion sizes; and a cup 18 with one or more fill indicias for indicating one or more portion sizes. The system 10 of place setting components of embodiments of the present invention provides for users to prepare and serve healthy food portions of meals, and further provides for users to consume such healthy portions of meals in a way that will visually, psychologically, and physically satisfy the users' physical desires and/or sensations for food.

Figure 2:
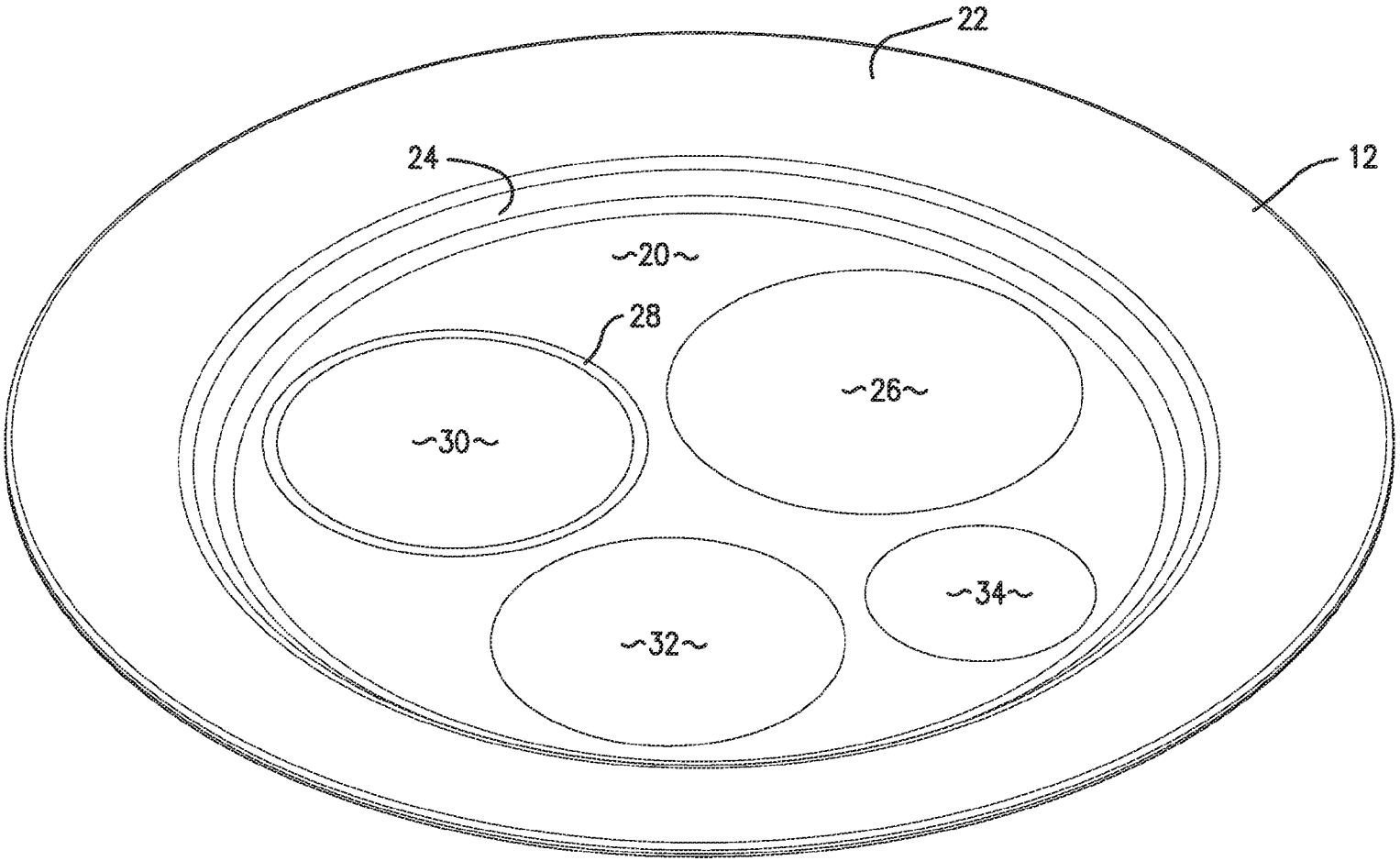
FIG. 2 is a perspective view of a serving side of the plate of the system of place-setting components as shown in FIG. 1.

With reference to FIG. 2, the plate 12 of embodiments of the present invention generally includes a bottom side and a serving side, with the plate broadly comprising a central well section 20 that is connected to an outer rim section 22 via an intermediate verge section 24. The well section 20 may generally be flat, with a bottom side that is configured to be placed in contact with a base surface. The base surface may include any type of generally-flat surface that may normally be used for setting plates, such as a table-top, counter-top, desk-top, or the like. In certain embodiments, the well section 20 may be circular; however, in certain other embodiments, the well section may have different shapes, such as oval, ellipsoid, square, or the like. The rim section 22 may generally be a ring-shaped rim that surrounds the well section 20, via the verge section 24, with a shape of the rim section corresponding to the shape of the well section 20. In certain embodiments, the rim section 22 may be positioned relatively higher than the well section 20, such that the rim section is upwardly displaced from the base surface when the bottom side of the well section is in contact with the base surface. The rim section 22 may be displaced upward via the verge section 24, which may extend upward from the well section 20 as it simultaneously extends radially outward from the well section. As will be discussed in more detail below, food components of a meal are generally placed within the well section 20 of the plate 12. By providing for the rim section 22 to bound the well section 20, the plate 12 appears larger in size, such that an amount of food placed within the well section appears plentiful and visually satisfying.

In embodiments such as illustrated in FIG. 2, in which the plate 12 is circular in shape, a surface area of either the bottom side or the serving side of the plate may generally be defined by a diameter or a radius of the plate. It is understood that a curvature of the verge section 24 may provide for a true surface area of the plate to be greater than that indicated by the radius or diameter. However, because a size of the verge section 24 is generally smaller than a size of the well section 20 and/or the rim section 22, the radius and/or diameter of the plate 12 is used herein to represent the surface area. Corresponding with the surface area of the plate 12, a surface area of the well section 20 may generally be defined by a radius or a diameter of the well section. Further, surface areas of the rim section 22 and the verge section 24 may generally be defined by radial differences in widths of each of the sections. Thus, such radial differences may be added to a radius of the well section 22 when determining the radius of the plate 12, or alternatively, the radial differences may be considered twice when determining the diameter of the plate. As an illustrative example, if the well section 20 has a diameter of 7 inches, the verge section 24 has a width of 0.25 inch, and the rim section 22 has a width of 2 inches, then the plate 12 would have a total diameter of 11.5 inches, which includes the diameter of the well section (i.e., 7 inches), plus two times the width of the verge section (i.e., 0.5 inches), plus two times the width of the rim section (i.e., 4 inches).

Embodiments of the present invention provide for the surface area of the plate 12, as defined by each of the surface areas of the well section 20, the rim section 22, and the verge section 24, to be precisely formed, so as to visually and psychologically satisfy a user's desires for food, while maintaining a sufficient surface area to contain enough food to physically satisfy nutritional needs of the user. In certain embodiments, the diameter of the plate 12 may be between about 1.3 to about 1.9 times the diameter of the well section 20, about 1.4 times the diameter of the well section, or about 1.6 times the diameter of the well section. For instance, certain embodiments of the present invention may provide for: the diameter of the plate to be between about 8 inches to about 11 inches, the diameter of the well section 20 to be between about 5 inches to about 7.5 inches, and a width of the rim section 22 to be between about 1.3 inches to about 1.75 inches. By maintaining the ratio between the diameter of the plate 12 and the well section 20 between such above-described values, food components of a meal placed within the well section will appear larger and more plentiful to users. As a result, the meal will appear more satisfying, thus encouraging users to place less food components on the plate 12 and to ultimately consume less food. A specific, non-limiting exemplary measurement for the plate 12 may include the diameter of the plate being about 10.625 inches, with the diameter of the well section 20 being about 7 inches and the width of the rim section 22 being about 1.625 inches. An additional specific, non-limiting exemplary measurement for the plate 12 may include the diameter of the plate being about 8.125 inches, with the diameter of the well section 20 being about 5 inches and the width of the rim section 22 being about 1.375 inches. However, it is understood that such specific measurements are provided solely for illustrative purposes, and are not intended to be limiting.

As previously stated, embodiments of the present invention provide for the plate 12 to include one or more serving areas on the serving side of the plate. As illustrated by FIG. 2, the serving areas may be indicated by one or more closed curves, such as circles, ovals, ellipses, squares, or the like, which are each formed within the well section 20 of the serving side of the plate 12. The closed curves may be formed on the plate 12 via markings formed on the serving side of the well section 20, or in certain other embodiments, the closed curves may be formed via grooves formed on the surface of the serving side of the well section. In still other embodiments, an entire surface area of the surface enclosed by the serving area may be formed as a depression on the serving side of the well section 20.

The surface areas of each of the serving areas are configured to accept a food portion size for one or more food components of a meal. For instance, as illustrated in FIG. 2, the plate 12 may include five serving areas. Each of the five serving areas may be configured to accept food components of various food portion sizes as may be necessary to fit dietary or nutritional requirements. For example and with reference to FIG. 2, a first serving area 26 may enclose a surface area configured to accept a food component with a portion size of about 1 cup; a second serving area 28 may enclose a surface area configured to accept a food component with a portion size of about 0.75 cup; a third serving area 30 may be configured to accept a food component with a portion size of about 0.5 cup; a fourth serving area 32 may be configured to accept a food component with a portion size of about 0.25 cup; and a fifth serving area 34 may be configured to accept a food portion size of about a 0.125 cup. In certain embodiments, the first, second, third, fourth, and fifth serving areas may have diameters that are approximately 3.3125 inches, 3.0625 inches, 2.875 inches, 2.6875 inches, and 1.75 inches, respectively. However, it is understood that number, specific diameters, and relative positioning of the serving area may be altered as necessary for various meal, dietary, or nutritional requirements, as well as for stylistic choices. For example, the above-provided serving area configuration with five serving areas may be implemented for a dinner-type meal that includes four or five food components. However, additional embodiments of the plate 12 may include fewer serving areas for use during meals that require fewer food components, such as lunch-type meals for instance.

Variations in relative positioning of the serving areas of the plate 12 may, in certain embodiments, provide for certain serving areas to be concentric. For example, as shown in FIG. 2, serving area 30 is illustrated as lying entirely within serving area 28. Such concentric arrangement of the serving areas may provide for the plate 12 to include more positional variations of serving areas on its well section 20 than if all serving areas were required to be separated. In addition, certain embodiments of the present invention may provide for each of the serving areas to be separated by at least some surface area within the well section 20. By providing space between serving areas positioned within the well section 20, embodiments provide for the food components positioned within the serving areas to appear more substantial and plentiful, such that the food components will visually and psychologically satisfy a user's desires for food.

As described, the above-provided specific serving area configuration with five serving areas may be implemented for certain food components of a dinner-type meal. For such a meal, the 1 cup portion size may be used for fruits and vegetables, for instance. The 0.75 cup and/or the 0.5 cup portion size may be used for carbohydrates, such as starches or grains. The 0.25 cup may be used for proteins, such as meats. Finally, the 0.125 cup portion size may be used for various types of sauces, dressings, jams, or the like. However, it is understood that such exemplary descriptions of food components to serving areas is provided for illustration only, and embodiments of the present invention provide for various types of food components to be included within the serving areas as may be necessary to meet various meal, dietary, or nutritional requirements. Further, because each of the serving areas of the plate 12 are associated with portion sizes that correspond to food components that may be placed within the respective serving areas, the serving areas may be used to indicate and hold appropriate portion sizes of specific types of food components that are needed to achieve a complete and healthy meal. As such, a user can be assured that she will serve and consume appropriate portions of each required type of food component to maintain healthy eating habits as directed and required by dietary guidelines. Further, it is understood that each of the serving areas may correspond to other units of measurement, such as ounces, pounds, or the like.

In additional embodiments of the present invention, the plate 12 may include a plurality of color schemes on its serving side. In certain embodiments, the color scheme may include coloring of its well section 20, rim section 22, and/or verge section 24 in cool colors, such as blues, greens, purples, browns, greys, or the like. Specifically, such cool colors may include the following colors included in the Pantone Matching System (PMS™) scale: PMS™ Color 7468C, 312C, 584C, and/or 723C. Certain embodiments may provide for the plate 12 to specifically not include hot colors, such as reds, oranges, or yellows. In particular, the plate 12 that includes cool colors may provide a calming effect on users, which causes the user to eat slower and, thus, less food. Alternatively, hot colors may stimulate the user's senses, thus inducing faster eating and causing more food to be eaten. Further, in certain embodiments, the well section 20 and the rim section 22 may be of different contrasting colors. For instance, the well section 20 may be formed in a cool color, while the rim section 22 is formed in a basic white color. Alternatively, the well section 20 may be formed in the basic white color, while the rim section 22 is formed in a cool color. By maintaining a color contrast between the well section 20 and the rim section 22, food components of a meal placed within the well section will appear larger and more plentiful to users. As a result, the meal will appear more satisfying, thus encouraging users to place less food components on the plate 12 and to ultimately consume less food. In even further embodiments, the well section 20 and/or the rim section 22 may have a color contrast with the verge section 24, so as to provide for additional visual color contrast for the user.

Figure 3:
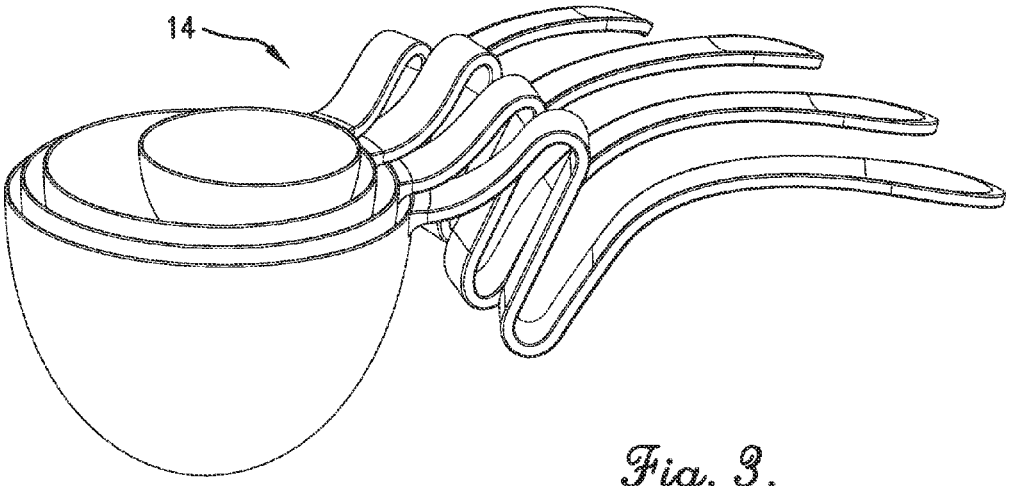
FIG. 3 is perspective view of the set of nestable serving spoons of the system of place-setting components as shown in FIG. 1.
Figure 4:
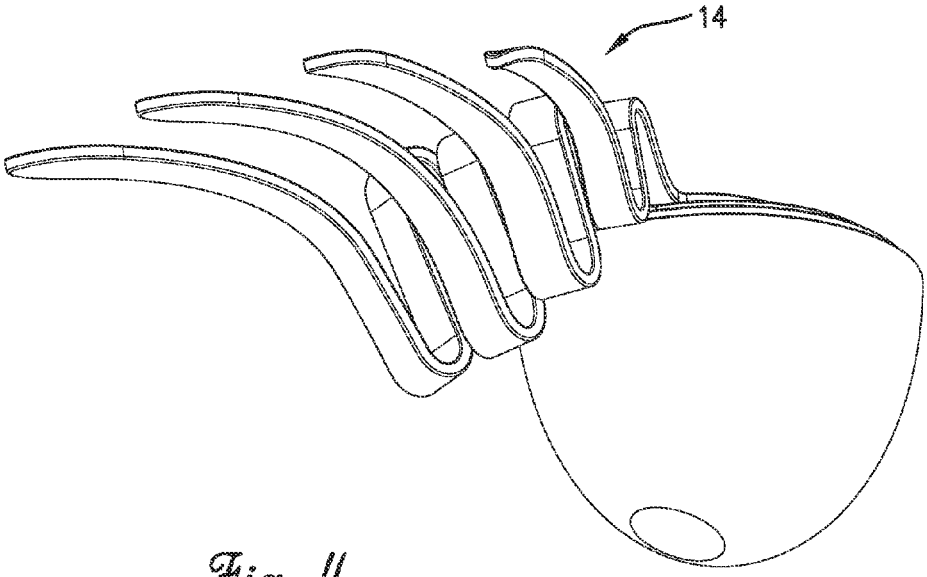
FIG. 4 is a rear plan view of the set of nestable serving spoons from FIG. 3 and the system of place-setting components as shown in FIG. 1.
Figure 5:
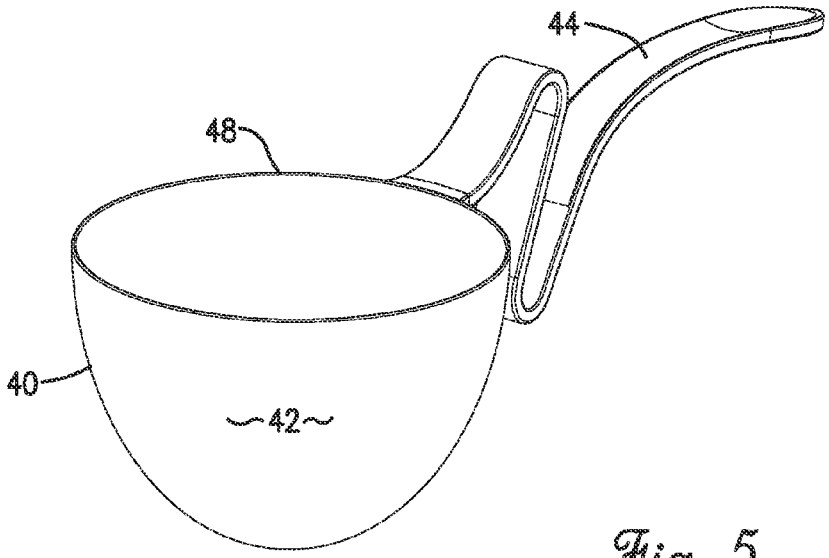
FIG. 5 is a front elevation view of a serving spoons from the set of nestable serving spoons from FIGS. 3-4 and the system of place-setting components as shown in FIG. 1.
Figure 6:
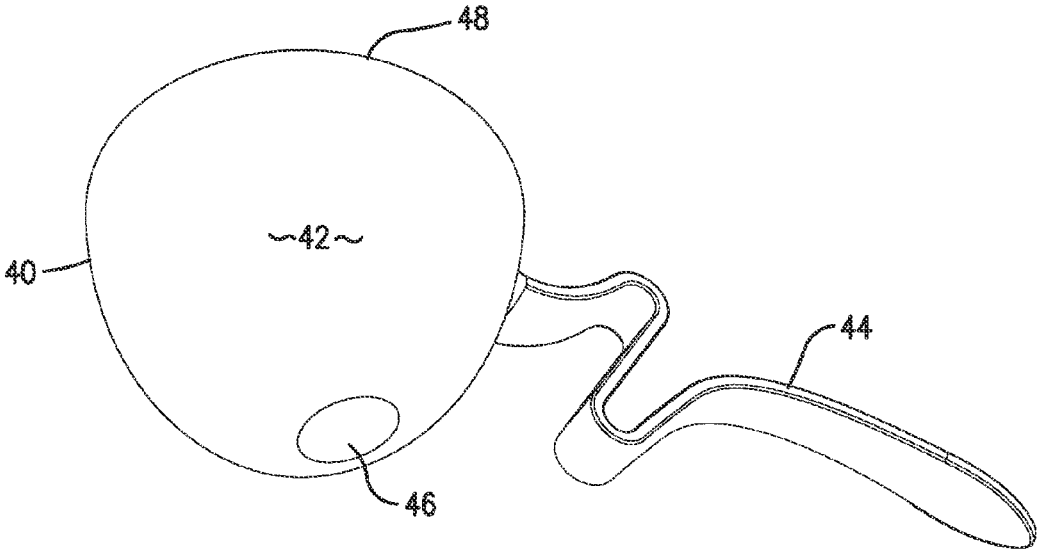
FIG. 6 is a bottom plan view of the serving spoon from FIG. 5 of the set of nestable serving spoons from FIGS. 3-4 and the system of place-setting components as shown in FIG. 1.

With reference to FIGS. 3-4, the system 10 of place setting components may include the nestable set of serving spoons 14. Each of the serving spoons in the nestable set 14 may have generally similar shapes; however, each of the spoons is scaled larger or smaller than the other spoons, such that each of the spoons in the set can be nested together. In certain embodiments, however, one or more of the serving spoons in the nestable set 14 may not be nestable, such that the certain serving spoons must be maintained separately from the nestable set. FIGS. 5-6 illustrate an exemplary serving spoon 40 of the nestable set 14. The serving spoon 40 broadly comprises a bowl-shaped cup 42 attached to a handle 44 with a plurality of segments. In certain embodiments the bowl-shaped cup may include a bottom-facing flat surface 46 (not shown on FIG. 5) on its lower portion. As will be discussed in more detail below, the flat surface 46 of the bowl-shaped cup 42 may provide for the serving spoon to be positioned on a base surface, such as a table-top, counter-top, desk-top, or the like. Additionally, the bowl-shaped cup 42 also generally includes an upper-rim 48 at its top-most portion that presents a closed loop curve. The bowl-shaped cup 42 presents an interior volume that is configured to contain a portion size dependent on a size of the serving spoon. For example, in embodiments with four serving spoons included in the nestable set 14, such as illustrated in FIGS. 3-4, the volumes of the bowl-shaped cups of each of the four serving spoons may be 1 cup, 0.75 cup, 0.5 cup, and 0.125 cup. Thus, each of the volumes of the bowl-shaped cups may correspond to the portion sizes of the serving areas included on the plate 12. In additional embodiments, the set 14 of serving spoons may include spoons with bowl-shaped cups that have volumes of 0.25 cup and/or 0.33 cup.

In addition, embodiments of the present invention may provide for diameters of each of the upper-rims 48 of serving spoons in the nestable set 14 to correspond with the diameters of the serving areas from the plate 12. For example, in embodiments with a nestable set 14 of four serving spoons and with the plate 12 as illustrated in FIG. 2, the diameters of the upper rims 48 of the serving spoons may be approximately 3.3125 inches, 3.0625 inches, 2.6875 inches, and 1.75 inches. The bowl-shaped cups 42 of the serving spoons with above-described upper rim 48 diameters may correspond to the 1 cup, the 0.75 cup, the 0.5 cup, and the 0.125 cup volumes respectively. Thus, the diameters of the upper rims 48 of the serving spoons may generally correspond to one or more of the diameters of the serving areas of the plate 12.

Figure 7:
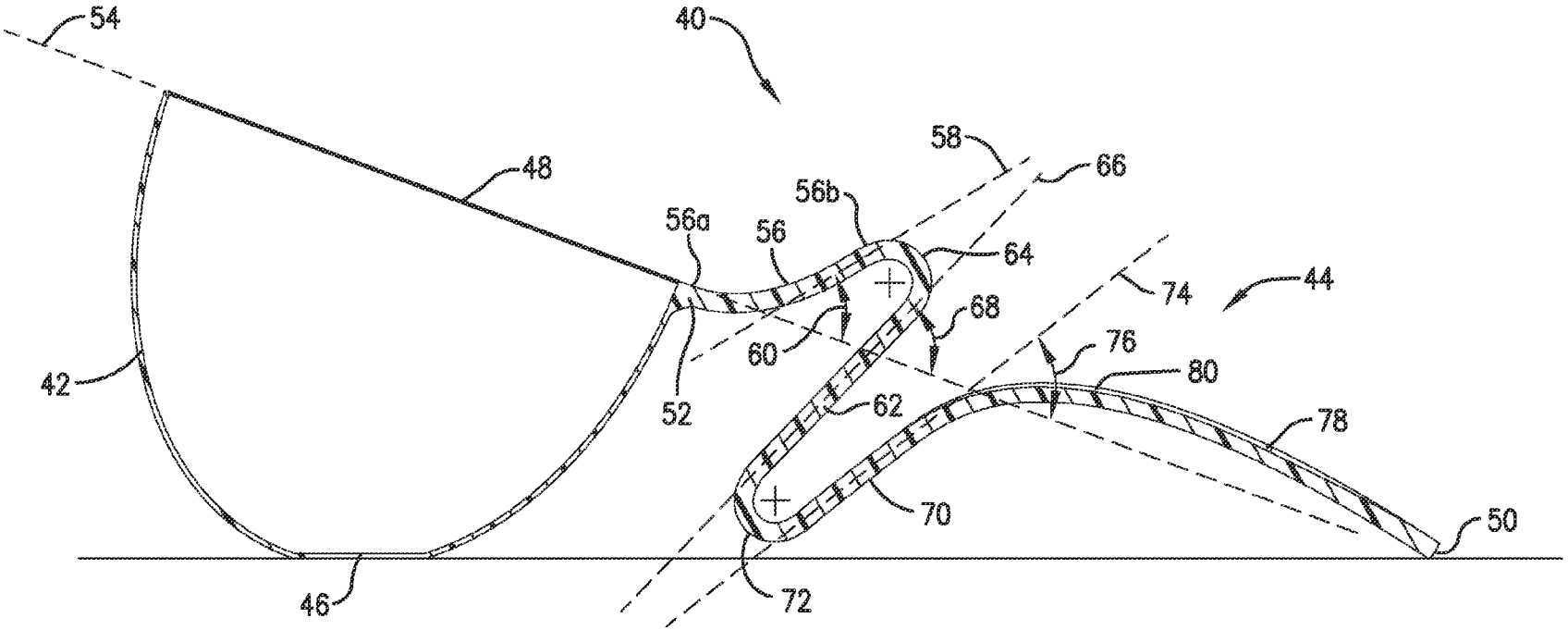
FIG. 7 is a cross-sectional view of the serving spoon from FIGS. 5-6 resting on a base surface.

Each handle 44 of the serving spoons in the nestable set 14 may include a plurality of connected segments that provide for the serving spoons to engage in a plurality of positions with items such as the base surface, a serving bowl, or other kitchen utensil and/or accessory. In certain embodiments, such as illustrated in FIGS. 3-6, and as best illustrated in FIG. 7, each serving spoon in the nestable set 14 may include the handle 44 with four segments. With reference to FIG. 7, the handle 44 includes distal and proximal ends 50,52, with the proximal end connected to an exterior side of the bowl-shaped cup 42. For purposes of providing reference, FIG. 7 includes a reference plane 54 that includes the entire closed-loop curve presented by the upper rim 48 of the bowl-shaped cup 42. A first segment 56, generally arcuate in shape, extends distally from the proximal end 52, with a first portion 56*a* of a proximal-most section of the first segment being generally parallel with the reference plane 54, and a second portion 56*b* of a distal-most section of the first segment extending upward. In certain embodiments, a longitudinal centerline 58 of the second section 56*b* of the first segment 56 forms a first angle 60 with a portion of the reference plane 54 that lies distally with respect to the longitudinal centerline of the second section. In certain embodiments, the first angle 60 may be between about 30 degrees to about 150 degrees, between about 40 degrees to about 90 degrees, or about 45 degrees.

The handle 44 may additionally include a second segment 62 connected to the first segment 56 via a first arcuate connecting segment 64, with the second segment extending downward from the first arcuate connecting segment. In certain embodiments, a longitudinal centerline 66 of the second segment 62 forms a second angle 68 with a portion of the reference plane 54 that lies distally with respect to the longitudinal centerline of the second segment. In certain embodiments, the second angle 68 may be between about 15 degrees to about 165 degrees, between about 30 degrees to about 90 degrees, or about 60 degrees.

The handle 44 may further include a third segment 70 connected to the second segment 62 via a second arcuate connecting segment 72, with the third segment extending generally upward. In certain embodiments, a longitudinal centerline 74 of the third segment 70 forms a third angle 76 with a portion of the reference plane 54 that lies distally with respect to the longitudinal centerline of the third segment. In certain embodiments, the third angle 76 may be between about 15 degrees to about 165 degrees, between about 30 degrees to about 90 degrees, or about 55 degrees.

Finally, the handle 44 may include a fourth segment 78 connected with the third segment 70 via a third arcuate connecting segment 80. The fourth segment 78 extends generally distally from the third arcuate connecting segment 80 and may be generally parallel with the reference plane 54.

In certain embodiments, the first and second arcuate connecting segments 64,72 each have a radius of curvature that are approximately equal in magnitude. Additionally, the third arcuate connecting segment 80 may have a radius of curvature that is between about 8 to about 12 times the radius of curvature of the first and second arcuate connecting segments 64,72, or about 10 time radius of curvature of the first and second arcuate connecting segments 64,72. However, embodiments of the present invention may provide for the arcuate connecting segments to have different radii of curvatures as required for the serving spoons to engage in a plurality of positions with various items, of which, certain positions and items are described below.

Figure 8:
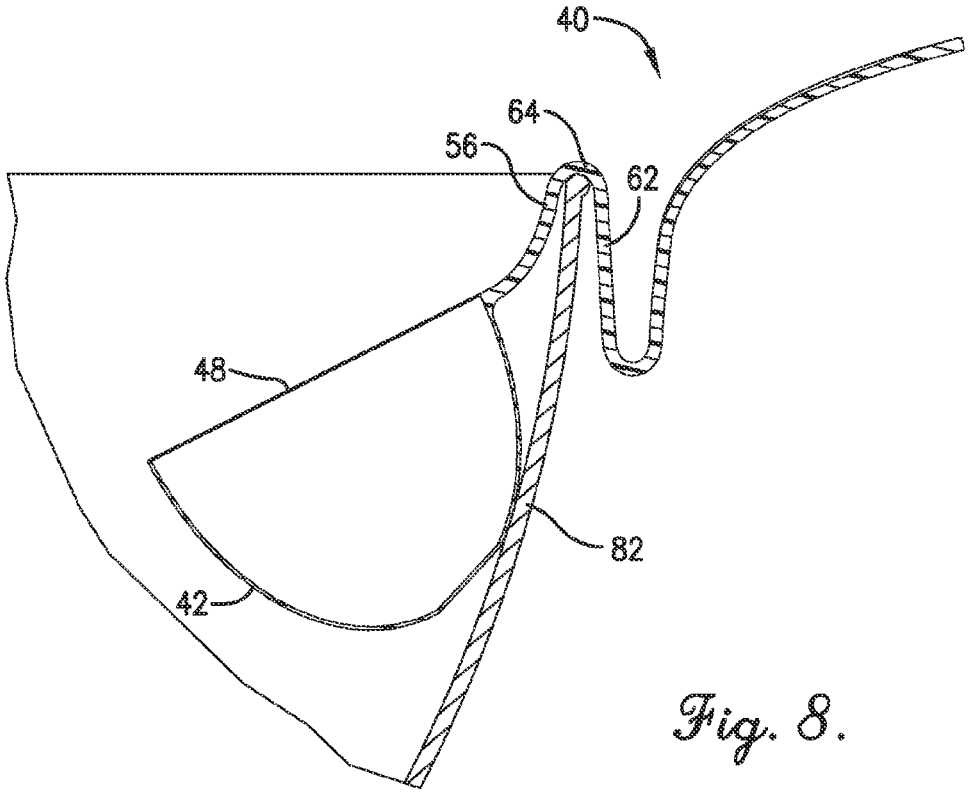
FIG. 8 is a cross sectional view of the serving spoon from FIGS. 5-6 engaged with a serving bowl in a first position.
Figure 9:
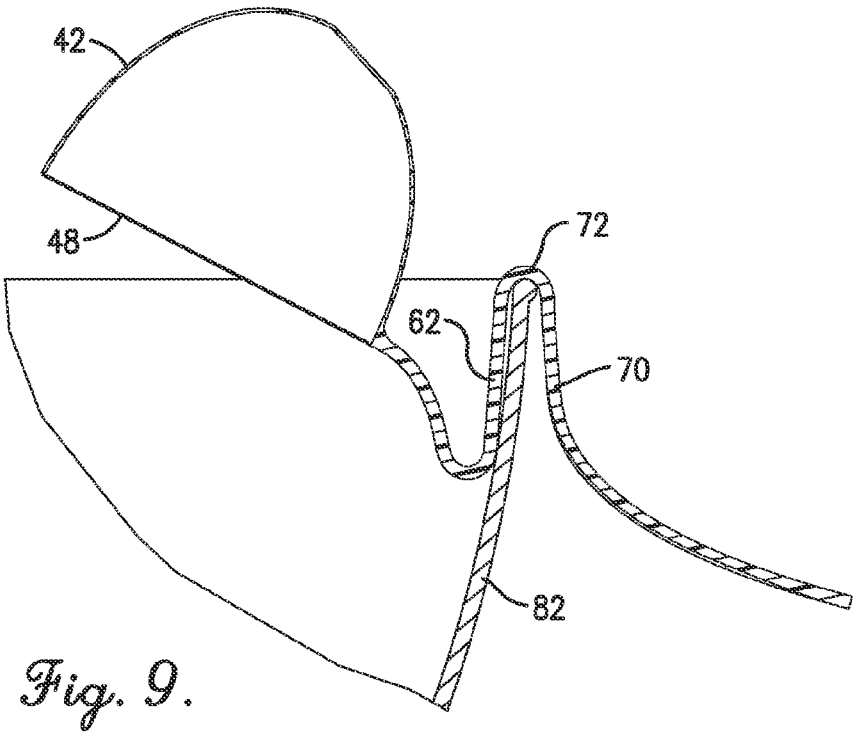
FIG. 9 is a cross sectional view of the serving spoon from FIGS. 5-6 engaged with the serving bowl from FIG. 8 in a second position.

The plurality of segments of the handle 44 provide for the serving spoon to be situated in a plurality of stable positions. For instance, with reference to FIG. 8, the first segment 56, the second segment 62, and the first arcuate connecting segment 64 provide for the serving spoon 40 to be engaged in a first position with a serving bowl 82. In such embodiments, the first position is such that the upper rim 48 of the serving spoon faces in a generally upward direction and further such that the bowl-shaped cup 42 is operable to maintain a food component while being engaged in the first position with the serving bowl. Additionally, with reference to FIG. 9, the second segment 62, the third segment 70, and the second arcuate connecting segment 72 provide for the serving spoon 40 to be engaged in a second position with the serving bowl 82, with the second position being such that the upper rim 48 of the serving spoon faces in a generally downward direction and further such that the bowl-shaped cup 42 is operable to be emptied of any food component while being engaged in the second position with the serving bowl. Further, returning to FIG. 7, the bottom-facing flat surface 46, the third segment 70, the third arcuate connecting 80 segment, and the fourth segment 78 provide for the serving spoon 40 to be engaged in a third position with a base surface, such as a table-top, a counter-top, a desk-top, or the like. In such embodiments, the third position provides for the upper rim 48 of the serving spoon 40 to face in a generally upward direction and further such that the bowl-shaped cup 42 is operable to maintain a food component while being engaged in the third position with the base surface.

In certain embodiments, the handle 44 of each of the serving spoons included in the nestable set 14 may additionally include a hook-shaped segment on its distal end 50. The hook-shaped segment may be used to hang each of the serving spoons from its distal end 50. For instance, the serving spoon may be hung from its distal end 50 on a rim of a serving bowl, on a ledge, a hook, a hanging-nail, or other various objects or surfaces. In certain other embodiments, the hook-shaped segment may be elongated, such that it extends proximally from the distal end 50, under the fourth section 78, and towards the third segment 70. In still even further embodiments, the distal end 50 of the handle 44 of the serving spoons may include an opening, such as a circular hole, that passes through a thickness of the handle. The opening may be used to hang the serving spoons by their distal ends 50 from a hook, hanging-nail, or other item.

Embodiments of the present invention may also provide for the handle 44 of the serving spoons in the nestable set 14 to include a width that remains generally constant as the handle extends from its proximal end 52 to its distal end 50. However, other embodiments may provide for the width of the handle 44 to vary as the handle extends from its proximal end 52 to its distal end 50. In still other embodiments, the handle 44 may include a gap that extends down a center of its width, between its proximal end 52 and its distal end 50. In such embodiments, the handle 44 may be presented in a fork-shape, with two sections, separated by the gap, which extend from the proximal end 52 to the distal end 50. Such an embodiment may provide for similar strength characteristics as the handle 44 with a constant width. However, the fork-shape may provide for less material to be used when forming the handle 44.

Figure 10:
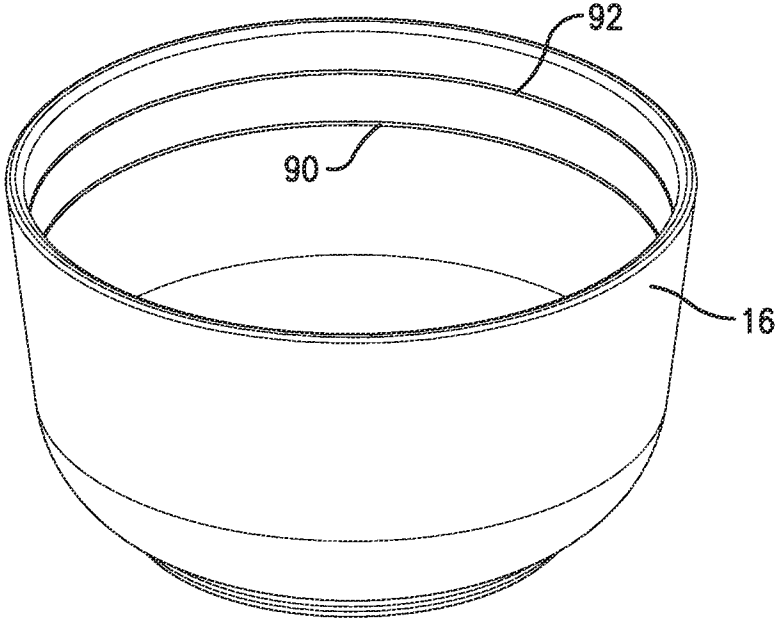
FIG. 10 is a perspective view of the bowl of the system of place-setting components as shown in FIG. 1.

The system 10 of place-setting components may additionally include the bowl 16, as illustrated in FIG. 10. The bowl 16 may comprise various sizes and shapes, and for instance, may include soup-bowls, cereal-bowls, or any other type of bowl that is configured to hold a liquid or other food component. In certain embodiments, the bowl 16 may include one or more fill line indicias that each indicates one or more fluid portion sizes that may be contained within the bowl. For instance, as illustrated in FIG. 10, the bowl 16 may include a first fill line indicia 90, which indicates a fluid portion size of 8 ounces. Additionally, the bowl 16 may include a second fill line indicia 92, which indicates a fluid portion size of 12 ounces. However, such fluid portion sizes are provided for exemplary purposes, and the bowl 16 may include any number of fill line indicias, each capable of representing various fluid portion sizes. The fill line indicias may include markings formed on an inner surface of the bowl 16, or in certain other embodiments, the fill line indicias may include grooves formed on the inner surface of the bowl. In certain embodiments, the bowl 16 may include a rim section (not shown) that surrounds and extends away from an upper portion the bowl. The rim section of the bowl 16 may be similar to that of the rim section 22 of the plate 12. By including the rim section on the bowl 16, food components of a meal placed within the bowl will appear larger and more plentiful to users. As a result, the food component will appear more satisfying, thus encouraging users to place less food components in the bowl 16 and to ultimately consume less food. Additionally, the volumes of the serving spoons of the nestable set 14 may correspond the fluid portion sizes of the bowl 16, as indicated by the fill indicias. Thus, the serving spoons may be used to add appropriate portions of food components to the bowl 16. For example, if a user is required to add 8 ounces of soup to the bowl 16, the user may use the serving spoon with a volume of 1 cup to fill the bowl with soup to the first fill line indicia 90.

Figure 11:
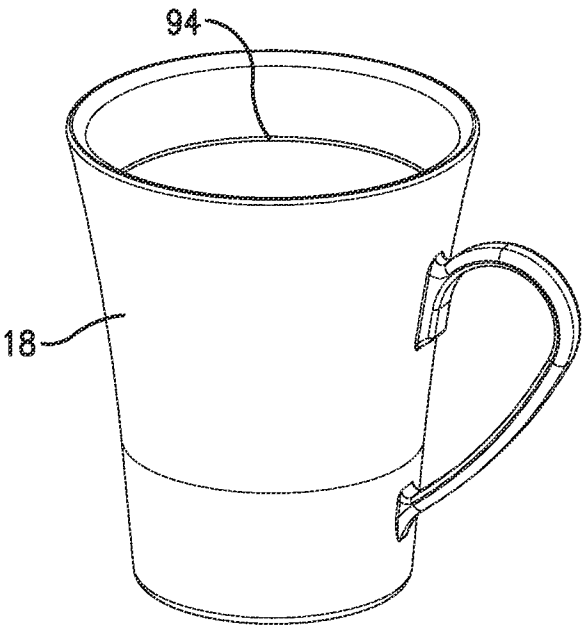
FIG. 11 is a perspective view of the cup of the system of place-setting components as shown in FIG. 1.

The system 10 of place-setting components may further include the cup 18, such as is illustrated in FIG. 11. The cup 18 may comprise various sizes and shapes, and for instance, may include water glasses, coffee-mugs, wine-glasses, or any other type of cup that is configured to hold a liquid or other food component. In certain embodiments, the cup 18 may include one or more fill line indicias that each indicates one or more fluid portion sizes that may be contained within the cup. For instance, as illustrated in FIG. 11, the cup 18 may simply include a fill line indicia 94, which indicates a fluid portion size of 8 ounces. However, such a fluid portion size is provided for exemplary purposes, and the cup 18 may include any number of fill line indicias, each capable of representing various fluid portion sizes. The fill line indicias may include markings formed on an inner surface of the cup 18, or in certain other embodiments, the fill line indicias may include grooves formed on the inner surface of the bowl. Additionally, the volumes of the serving spoons of the nestable set 14 may correspond the fluid portion sizes of the cup 18, as indicated by the fill indicias. Thus, the serving spoons may be used to add appropriate portions of food components to the cup 18. For example, if a user is required to add 8 ounces of a fluid drink to the cup 18, the user may use the serving spoon with a volume of 1 cup to fill the cup with the fluid drink to the fill line indicia 94.

The nestable spoons 14, the bowl 16, and the cup 18 may each include a plurality of color schemes using the cool colors, as was previously described for the plate 12. As with the plate 12, the cool colors may provide a calming effect on users, such that the users may consume food components more slowly, so as to ultimately consume less food. In additional embodiments, certain portions of the nestable spoons 14, the bowl 16, and the cup 18 may have various components with contrasting colors. For example, in embodiments of the present invention that include the bowl 16 with a rim section, the rim section and an inner portion of the bowl may be of contrasting colors. For instance, the rim section may be formed in a basic white color, while the inner portion of the bowl 16 may be formed in a cool color. By maintaining a color contrast, food components placed within the bowl will appear larger and more plentiful to users. As a result, the food components will appear more satisfying, thus encouraging users to place less food components in the bowl 16 and to ultimately consume less food. Thus, it is understood that various place-setting components of the system 10 may be formed with color contrasting components, such that food components placed within them will appear larger and more plentiful.

As with the plates 12, the fill line indicias for each of the bowl 16 and cup 18 are associated with portion sizes that correspond to a food components that may be placed within the respective component. Thus, the fill line indicias may be used to indicate an appropriate portion of specific types of food components that should be placed within each of the components of the system 10. As such, the serving areas and/or fill line indicias may be used to indicate and hold appropriate portion sizes of specific types of food components that are needed to achieve a complete and healthy meal. As such, a user can be assured that she will serve and consume appropriate portions of each required type of food component to maintain healthy eating habits as directed and required by dietary guidelines. Further, as should be understood, the place-setting components of the system 10 work together in a complimentary fashion, such that users can use various components of the system to serve and consume appropriate portion sizes of food components for various types of entire meals. Thus, during a dinner-type meal for instance, the plate 12 may be used to hold appropriate portion sizes of carbohydrates, fruits and vegetables, proteins, and sauces, while the bowl 16 may be used to hold an appropriate portion size of a soup, salad, or pasta. Concurrently, the cup 18 may be used to hold an appropriate portion size of a drink, such as a juice, tea, soda, or the like. Further, as has previously been described, the nestable set of serving spoons 14 are each configured for serving such appropriate sizes of food components within the plate 12, the bowl 16, and the cup 18. As a result, a user can use the multiple components of the system 10 of place-setting components to serve and consume appropriate portion sizes for each food component of an entire meal.

Figure 12:
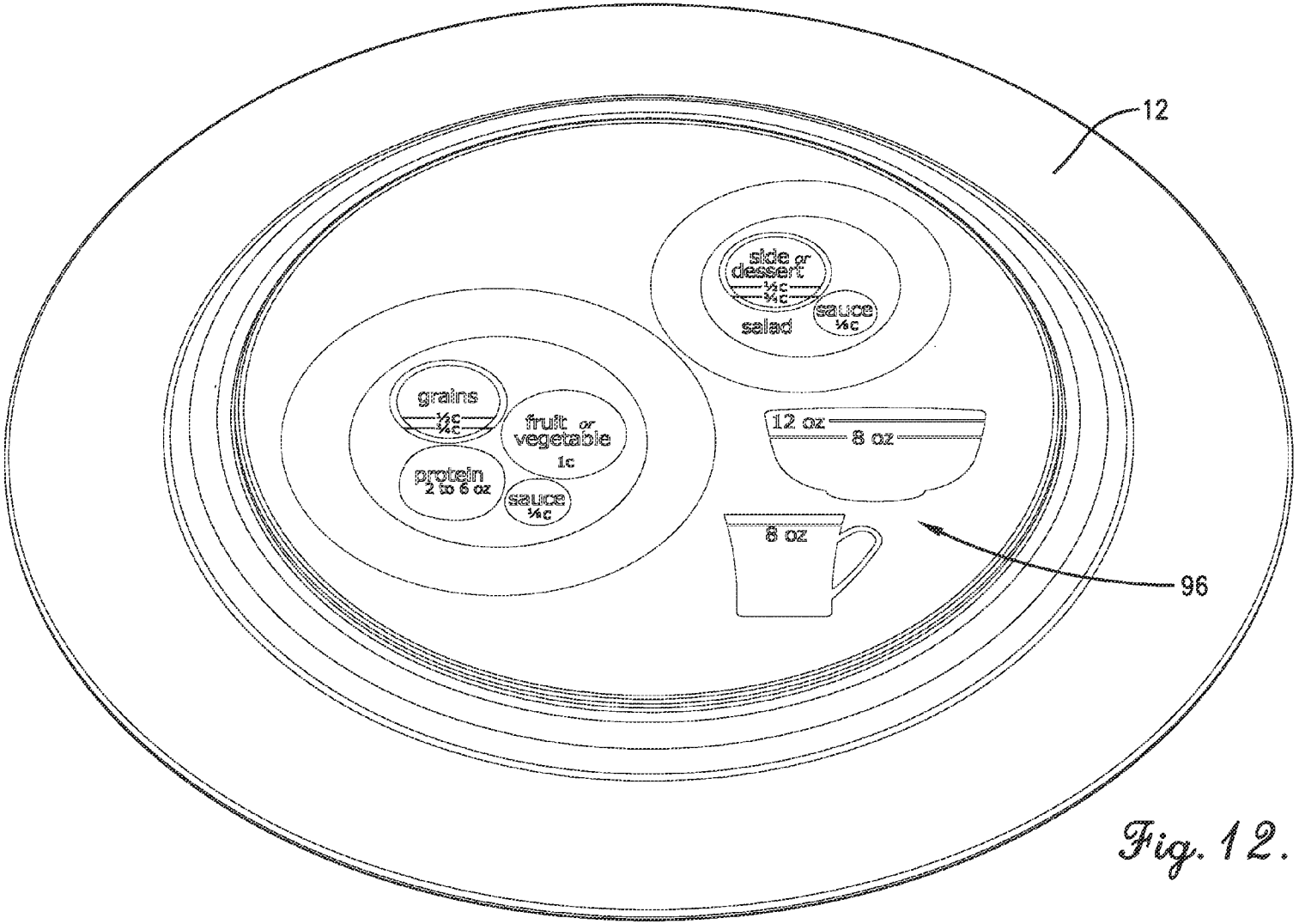
FIG. 12 is a perspective view of a bottom side of the plate of the system of place-setting components as shown in FIG. 1.

In certain embodiments and as illustrated in FIG. 12, the bottom side of the plate 12 may include a legend 96 formed on its bottom side. The legend 96 may include a graphic depiction of various components of the system 10 of place-setting components, so as to provide users with instructions and/or examples of how to implement the system. For example, as illustrated by FIG. 12, the legend 96 may illustrate a dinner plate and a salad plate, each including different numbers and sizes of serving areas. One plate may be, for instance, a dinner plate, while the other plate may be, for instance, a salad plate. Each of the serving areas of the plates may include an indication of the portion sizes and the corresponding food components that may be placed within the respective serving areas. Similarly, the bowl and the cup illustrated on the legend 96 may include indications of the fill line indicias, so as to provide the users with instruction and/or examples of how much fluid and/or other food components should be placed within the bowl and/or the cup. Thus, the legend 96 may be used to indicate appropriate portions of specific types of food components that should be placed within each of the components of the system 10. As such, that the user be ensured to serve and consume appropriate portions of each required type of food component to maintain healthy eating habits as directed and required by dietary guidelines.

Although the invention has been described with reference to the exemplary embodiments illustrated in the attached drawings, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A place setting dish for facilitating serving and eating healthy food portions, the place setting dish comprising:
- a bottom side; and
- a serving side opposite the bottom side, the serving side comprising:
  - a central well section having an outer edge;
  - an outer rim section surrounding the central well section and being upwardly offset from the central well section, the outer rim section having an inner edge;
  - an intermediate verge section extending around the central well section and extending upwardly from the outer edge of the central well section to the inner edge of the outer rim section; and
  - a plurality of serving areas positioned in the central well section, the serving areas being spaced from the intermediate verge section and being spaced from each other for spacing food components placed in the serving areas from each other and the central well section and the outer rim section being colored in different colors so as to make the food appear more plentiful to a user,
- the bottom side including a graphical legend for assisting the user in using the place setting dish correctly.

2. The place setting dish as claimed in claim 1, wherein the outer diameter of the rim section is between approximately 1.3 times and approximately 1.9 times the outer diameter of the central well section so as to make food placed in the central well section appear more plentiful to the user.

3. The place setting dish as claimed in claim 1, wherein the central well section includes a plurality of closed curves formed via markings indicating the serving areas.

4. The place setting dish as claimed in claim 1, wherein the central well section includes a plurality of closed curves formed via a depression indicating the serving areas and configured to at least partially retain food components placed in the serving areas.

5. The place setting dish as claimed in claim 1, wherein the central well section is substantially flat.

6. The place setting dish as claimed in claim 1, wherein at least two of the serving areas have different surface area sizes than each other.

7. The place setting dish as claimed in claim 1, wherein each serving area has a different surface area size than the other serving areas.

8. The place setting dish as claimed in claim 1, wherein at least one of the serving areas is an outer serving area including an inner serving area at least partially enclosed in the outer serving area so that a food component may be placed in one of the outer serving area or the inner serving area.

9. The place setting dish as claimed in claim 8, wherein the outer serving area is circular and the inner serving area is circular and concentric with the outer serving area.

10. The place setting dish as claimed in claim 1, wherein at least a portion of the serving side is colored in a cool color for calming the user and encouraging the user to eat slower.

11. The place setting dish as claimed in claim 1, wherein the central well section is colored in a cool color for calming the user and encouraging the user to eat slower.

12. The place setting dish as claimed in claim 11, wherein the outer rim section is white for contrasting with the color of the central well section.

13. The place setting dish as claimed in claim 1, wherein the outer rim section is colored in a cool color and the well section is white so as to contrast with the color of the outer rim section for calming the user and encouraging the user to eat slower.

14. The place setting dish as claimed in claim 1, wherein the legend indicates a type of food component to place in each serving area.

15. The place setting dish as claimed in claim 1, wherein the legend indicates an amount of food to place in each serving area.

16. The place setting dish as claimed in claim 1, wherein the legend includes a graphic of at least one additional dish for assisting the user in correctly using the at least one additional dish.

17. A plate for facilitating serving and eating healthy food portions, the plate comprising:
- a serving side comprising:
  - a substantially flat central well section having an outer edge;
  - an outer rim section surrounding the central well section and being upwardly offset from the central well section, the outer rim section having an inner edge, an outer diameter of the outer rim section being between approximately 1.3 times and approximately 1.9 times an outer diameter of the central well section, an outer diameter of the well section being between approximately 5 inches and approximately 7.5 inches, and a width of the outer rim section being between approximately 1.3 inches to approximately 1.75 inches so as to make food placed in the central well section appear more plentiful to a user, the outer rim section and the central well section having different colors for making food placed in the central well section appear larger and more plentiful to the user, one of the colors being a cool color for calming the user and encouraging the user to eat slower;
  - an intermediate verge section extending around the central well section and extending upwardly from the outer edge of the central well section to the inner edge of the outer rim section; and
  - at least three serving areas positioned in the central well section, the serving areas each having a closed curve, the serving areas being spaced from the intermediate verge section, at least some of the serving areas being spaced from each other for spacing food components placed in the serving areas from each other so as to make the food appear more plentiful to the user, one of the serving areas being contained entirely within another one of the serving areas, the serving areas each having different surface area sizes than the other serving areas; and
- a bottom side opposite the serving side, the bottom side including a graphical legend indicating a food component and a food component amount to place in each serving area for assisting the user in correctly using the plate.

* * * * *